United States Patent [19]

Jahnke et al.

[11] Patent Number: 4,557,625

[45] Date of Patent: Dec. 10, 1985

[54] INTERNAL SEALING ASSEMBLY

[76] Inventors: Richard P. Jahnke, 1002 Hawthorn Dr., Waukesha, Wis. 53186; James C. Keuper, 1950 Church View Dr., Brookfield, Wis. 53005; Wayne E. Hunnicutt, P.O. Box 62, Big Bend, Wis. 53103

[21] Appl. No.: 509,198

[22] Filed: Jun. 29, 1983

[51] Int. Cl.[4] ..... E02D 29/12

[52] U.S. Cl. ..... 404/25; 52/20; 285/109; 285/226; 285/236; 285/397; 277/212 FB; 403/50

[58] Field of Search ..... 404/25, 26, 5; 210/163, 210/164, 165; 52/19, 20; 49/466; 220/254, 256; 138/97; 285/370, 226, 371, 236, 397, 398, 109; 38/102.2; 403/289, 290, 297, 344, 80; 24/279, 280, 483, 569; 277/200, 212 FB, 404, 52, 277, 285, 403

[56] References Cited

U.S. PATENT DOCUMENTS

| | | | |
|---|---|---|---|
| 282,500 | 8/1883 | Conlan | 24/569 X |
| 1,988,240 | 1/1935 | Ellis | 24/569 X |
| 3,235,295 | 2/1966 | Solum | 403/344 X |
| 3,514,135 | 5/1970 | Cooper | 285/370 X |
| 3,722,041 | 3/1973 | Munse | 24/279 X |
| 3,958,313 | 5/1976 | Rossborough | 285/230 X |
| 4,242,164 | 12/1980 | Skinner | 277/207 A X |
| 4,305,679 | 12/1981 | Modi | 404/25 |
| 4,346,922 | 8/1982 | Ohtsuga et al. | 285/370 X |
| 4,469,467 | 9/1984 | Odill et al. | 404/25 |

*Primary Examiner*—Stephen J. Novosad
*Assistant Examiner*—Beverly E. Hjorth
*Attorney, Agent, or Firm*—Michael, Best & Friedrich

[57] ABSTRACT

The sealing assembly includes a relatively soft rubber, tubular sleeve having an axial length sufficient to span the joint between hollow members, such as the corbel joint between a manhole frame and a manhole casing, and a sealing portion in each of the opposite ends. The outer surface of each sealing portion is compressed radially outwardly in sealing engagement with the interior walls of the manhole frame and the manhole casing by a generally circular hoop which fits into a groove provided in the inside surface of the sleeve. Each hoop has circumferentially movable, end portions and a radially inwardly extending bracket mounted on each end portion at circumferentially spaced locations. These brackets are adjustably pulled toward each other, to increase the circumference of the hoop, by tightening a nut threaded onto the outer end of a bolt connecting the brackets together. The distance between the outer ends of the brackets can be adjusted, to maintain the brackets substantially parallel during tightening, by turning a nut threaded onto the outer end of a threaded member spaced radially inwardly from the tightening bolt and connected between the brackets.

15 Claims, 5 Drawing Figures

INTERNAL SEALING ASSEMBLY

BACKGROUND OF THE INVENTION

The invention relates to sealing assemblies and, more particularly, to sealing assemblies for internally sealing a joint between hollow members.

In a number of installations, particularly underground installations, joints between pipes or other hollow members are vulnerable to an undesired inflow of liquids from an external source. One such installation is the manholes for municipal sanitary sewers. The seal at the so-called corbel joint between the flange of the cast iron manhole frame and the masonry chimney portion or casing of the manhole is frequently broken from traffic loading and/or subsurface heaving caused by drastic ambient temperature changes during the summer and winter months. When this occurs, water flowing through the corbel joint and into the sanitary sewer can contribute to the possibility of overflow conditions at the waste treatment plant(s) during or shortly after rain storms.

One approach for alleviating this problem involves the use of a sealing assembly including a flexible tubular sleeve or boot which fits inside the manhole and spans the corbel joint and a pair of expansion units for compressing the sleeve radially outwardly into sealing engagement with the interior walls of manhole frame and the manhole casing at the opposite sides of the corbel joint.

For example, the Modi U.S. Pat. No. 4,305,679 discloses such a sealing assembly including expansion units having an outer rim which engages the inside of the sleeve, a concentric hub, and a plurality of threaded spokes. Nuts on the spokes are turned to radially expand the ring. The expansion units must be removed each time a workman needs to enter the sewer through the manhole. Also, radial compression on different segments of the outer rim can vary depending on how much the nut on the corresponding spoke is tightened. Consequently, it is difficult to insure that a uniform seal is provided around the entire circumference of the sleeve.

Enclosed is a Cretex brochure illustrating and describing another prior sealing assembly including a rubber sleeve having a corrugated or pleated central portion and a plurality of circumferentially extending ribs on the outer surface of the sealing portions. This arrangement requires the sleeve to be formed by an extrusion process. Each expansion unit includes a channel-shaped band connected together by a threaded member. A nut on the threaded member, requiring the use of an open end wrench, is turned to spread the band apart. In addition to the inconvenience involved in turning the nut, the bands are vulnerable to being flexed by overtightening the nut, in which case the compressive force applied by the band is not uniform around the circumference of the sleeve.

SUMMARY OF THE INVENTION

A primary object of the invention is to provide a simple, inexpensive sealing assembly for internally sealing a joint between hollow members.

Another object of the invention is to provide a sealing assembly including a simply constructed tubular sleeve and expansion units which can be conveniently installed and tightened to provide a uniform seal around the entire circumference of the sleeve.

A further object of the invention is to provide such a sealing assembly including a flexible sleeve which is arranged to permit its manufacture by forming techniques which do not necessarily require extrusion or molding.

A still further object of the invention is to provide such a sealing assembly which is particularly adaptable for use in internally sealing the corbel joint of manholes for sanitary sewers.

A yet further object of the invention is to provide a method for fabricating tubular sleeves of a sealing assembly, which method can be conveniently adapted to fabricate sleeves of various lengths and diameters.

Other objects, aspects and advantages of the invention will become apparent to those skilled in the art upon reviewing the following description, the drawing and the appended claims.

The sealing assembly provided by the invention includes a flexible, tubular sleeve having an axial length sufficient to span a joint between hollow members and opposite ends including a sealing portion. Each of the sealing portions has an outer surface which is compressed radially outwardly into engagement with the interior wall of the members, at locations axially spaced from the opposite sides of the joint, by an adjustable expansion unit which fits inside the sleeve. Each of the expansion units includes a generally circular hoop made from a rod-like member and having end portions which are circumferentially movable relative to each other, a first radially inwardly extending bracket affixed on one end portion of the hoop, and a second radially inwardly extending bracket circumferentially spaced from the first bracket and affixed on the other end portion of the hoop. The brackets are adjustably moved toward each other to increase the circumference of the hoop. In one embodiment, a spacer means is provided for maintaining the brackets substantially parallel while they are being moved toward each other to provide the desired sealing.

In one embodiment, the brackets are connected together by a threaded member, such as a bolt, having one or the head end connected to one bracket and having an opposite end slidably projecting through an aperture in the other bracket. The brackets are moved toward each other by tightening a nut threaded on the outer end of the bolt outside the other bracket. The spacer means can include another threaded member having one end connected to one of the brackets at a location spaced radially inwardly from the tightening bolt and an opposite end slidably projecting through an aperture in the other bracket. The distance between the inner ends of the bracket can be adjusted, to maintain their relative orientation substantially uniform, by turning a nut threaded onto the outer end of the threaded member. This nut is tightened against the inside of one bracket.

The sleeve preferably is made from sheets of an uncured rubber composition which are wrapped around a mandrel having an outer configuration corresponding to the inside shape and size of the sleeve and which are cured on the mandrel to form the sleeve as a one-piece unit.

DESCRIPTION OF THE PREFERRED EMBODIMENTS

The sealing assembly provided by the invention is adaptable for use in internally sealing the joints between a wide variety of hollow members, including vertical and horizontal installations. It is particularly adaptable for use in internally sealing the corbel joint in manhole installations and will be described in connection with that application.

Figure 1:
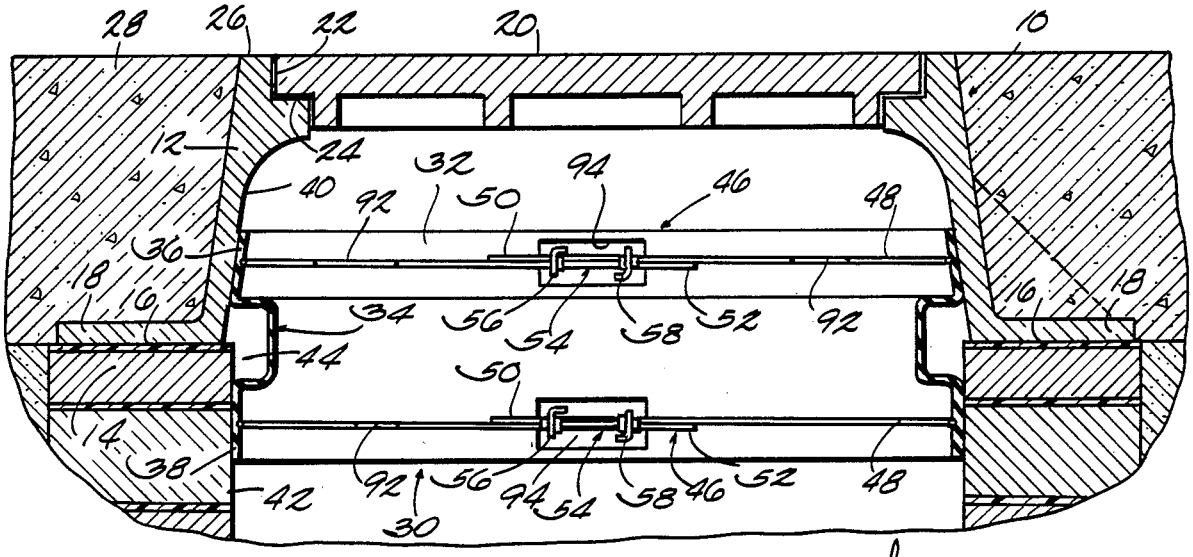
FIG. 1 is a fragmentary, vertical cross sectional view of a sewer manhole installation shown with a sealing assembly of the invention installed.

Illustrated in FIG. 1 is a conventional sewer manhole 10 including a cast iron manhole frame 12 supported on a masonry chimney portion or casing 14. The interface or joint 16 between a lower flange 18 on the manhole frame 12 and the manhole casing 14 is commonly referred to as the corbel joint. In actual practice, the manhole frame 12 may be supported on one or more pre-cast concrete rings or a ring of bricks or concrete blocks mortared in place on top of the chimney portion of the manhole.

The manhole 10 is closed by a manhole cover 20 including a radially extending flange 22 which rests on a shoulder 24 of the manhole frame 12. The top surface of the manhole cover 20 is generally level with the top edge 26 of the manhole frame 12 and the surface of the pavement 28 surrounding the manhole frame 12.

A sealing assembly 30 of the invention is mounted inside the manhole 10 to prevent the inflow of water through the corbel joint 16. The sealing assembly 30 includes a waterproof, flexible, tubular sleeve 32 having an axial length sufficient to span the corbel joint 16. In the embodiment illustrated in FIGS. 1–4, the sleeve 32 includes a central portion 34 of a reduced diameter and first and second sealing portions 36 and 38 of larger diameter extending from the opposite ends of the central portion 34. The sealing portions 36 and 38 preferably have a generally smooth outer surface which can be compressed into sealing engagement with the interior surface or wall 40 of the manhole frame 12 and the interior surface or wall 42 of the manhole casing 14 as explained in more detail below.

The sleeve 32 preferably is made from a relatively soft rubber composition, such as neoprene rubber, and the sealing portions 36 and 38 preferably have thicker walls than the central portion 34. This permits the outer surfaces of the sealing portion 36 and 38, when compressed radially outwardly, to effectively flow into surface imperfections in the interior walls of the manhole casing 14 and/or the manhole frame 12. The unexpanded length or height of the sleeve 30 is somewhat greater than the vertical distance between the desired sealing areas on the manhole frame 12 and the manhole casing 14. This additional height and the thinner walls of the central portion 34 permits the central portion 34 to be gathered into a fold which forms an annular pocket 44 spanning the corbel joint 16 as illustrated in FIG. 1. This fold accomodates both vertical and horizontal movement of the manhole frame 12 relative to the manhole casing 14, such as from frost heaving, without placing any strain on either of the seals.

If desired, the length or height of the sleeve 32 can be increased so that the axial length of the central portion 34 is sufficient to span one or more chimney joints below the corbel joint.

The seals between the sleeve sealing portions 36 and 38 and the manhole frame 12 and the manhole casing 14 are provided by expansion units 46 including a generally circular hoop 48 formed from a rod-like member and having end portions 50 and 52 which preferably overlap as illustrated. The circumference, and thus the diameter, of the hoop 48 is adjusted by a clamping arrangement 54 including a first radially inwardly extending bracket 56 affixed on the hoop end portion 50 and a second radially inwardly extending bracket 58 circumferentially spaced on the first bracket 56 and affixed on the hoop end portion 52. The brackets 56 and 58 are spaced circumferentially inwardly from the actual terminal ends of the hoop 48.

Figure 2:
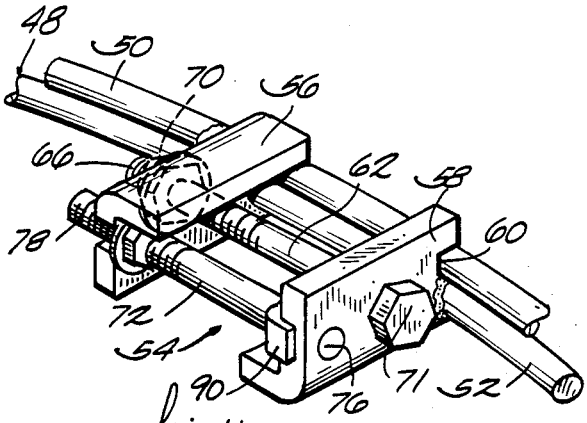
FIG. 2 is an enlarged and fragmentary perspective view of the overlapping ends of a hoop and the clamping arrangement for adjustably increasing the circumference of the hoop to provide the desired compression on the sleeve.
Figure 3:
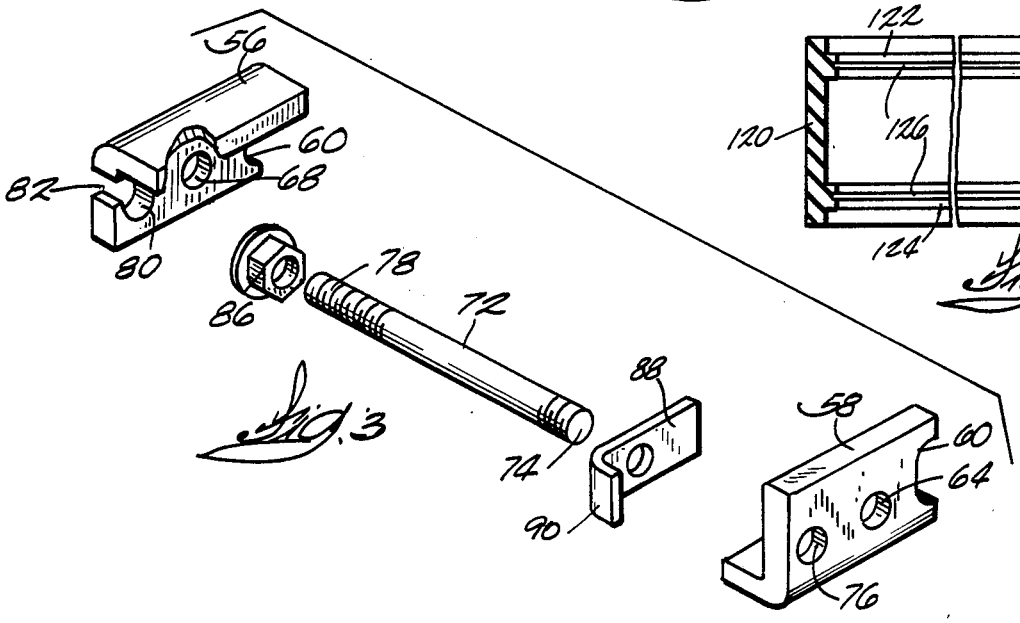
FIG. 3 is an exploded, perspective view of the brackets and spacer of the clamping arrangement shown in FIG. 2.

As best shown in FIGS. 2 and 3, the first and second brackets 56 and 58 have an elongated recess 60 for receiving both of the overlapping end portions 50 and 52 of a hoop 48, one on top of the other. More specifically, the hoop end portion 50 is located in the upper portion of the recesses 60 in both the brackets 56 and 58, but is affixed only to the first bracket 56. The hoop end portion 52 is located in the lower portion of the recesses 60 in both brackets 56 and 58, but is affixed only on the second bracket 58. Thus, the hoop end portions 50 and 52 are circumferentially movable relative to each other and the circumference of the hoop 48 can be increased to compress the outer surfaces of the sleeve sealing portions 36 and 38 radially outwardly into engagement with the interior walls of the manhole frame 12 and the manhole casing 14 by moving the brackets 56 and 58 toward each other.

The rod-like member forming a hoop 48 can be in various forms and have a variety of cross sectional shapes so long as the area of the compressive force it applies on sleeve sealing areas 36 and 38 is relatively small. For instance, it can be a solid rod having a circular, square or rectangular cross section or a tubular member having a circular, square or rectangular cross section and a sufficient wall thickness to prevent crimping of the tube wall when the hoop is tightened to provide the desired clamping action. Also, the rod-like member can be made from a variety of materials having sufficient structural integrity to provide the desired clamping action. At present, a solid circular rod of stainless steel is preferred.

In the preferred embodiment illustrated, this desired clamping action is provided by a threaded member or bolt 62 extending through an aperture 64 in the second bracket 58 and having an outer end 66 slidably projecting through an aperture 68 in the first bracket 56 and a nut and washer assembly 70 threaded onto the outer end 66 of the bolt 62 outside the first bracket 56. Since both the bolt head 71 and the nut and washer assembly 70 are located outside of the brackets 56 and 58, the nut and washer assembly 70 can be conveniently tightened with a box or rachet wrench.

As the nut and washer assembly 70 is tightened, the outer ends of the brackets 56 and 58 have a normal tendency to "toe in" toward each other which can cause the inner ends, and thus the end portions 50 and 52 of the hoop 48, to pull away from the inside surface of the sleeve sealing portions 36 and 38. This can result in a reduced radially outward compression behind the brackets 56 and 58 and possible leakage in that area.

This problem is minimized by providing an adjustable compression or a spacer member 72 for maintaining the relative orientation of the brackets 56 and 58 substantially uniform as the nut 70 is tightened. In the preferred embodiment illustrated, the spacer members 72 can be adjusted to hold the brackets substantially parallel. The spacer member 72 has one end 74 which is removably inserted into an aperture 76 in the second bracket 58 and a threaded opposite end 78 which extends through an aperture 80 in the first bracket 56. The first bracket 56 includes a slot 82 opening into the aperture 80.

The distance between the outer portions 56 and 58 is adjusted by a nut and washer assembly 86 threaded onto the outer end 78 of the spacer member 72 and located inside the first bracket 56. Rotation of the spacer member 72 relative to the second bracket 58 during tightening or loosening of the nut 86 is restrained by a clip 88 affixed on the spacer member 72 and having an outturned tab 90 which engages the outer edge of the second bracket 58.

Each of the hoops 48 is received in a circumferentially extending groove 92 provided in the inside surface of each of the sleeve sealing portions 36 and 38. In order to insure proper location and retention of the hoops 48 during and after installation, the grooves 92 preferably have a generally semi-circular cross section with a diameter substantially the same as that of the hoops 48 and include segments for receiving the overlapping end portions 50 and 52 of a hoop 48 as well as a rectangular recess 94 for receiving the inner ends of the brackets 56 and 58.

In order to facilitate installation of the hoops 48, the bolt 62 and the spacer member 72 preferably are removably mounted on both the brackets 56 and 58. With the bolt 62 and the spacer member 72 removed, the brackets 56 and 58 can be pulled apart as far as necessary to decrease the hoop diameter for convenient insertion into place inside the sleeve 32. The brackets 56 and 58 are then released and a hoop 48 is slipped into a groove 92 with the brackets 56 and 58 located in the recess 94. After the bolt 62 is inserted through the apertures 64 and 68 in the brackets 56 and 58, the nut and washer assembly 70 is threaded onto the outer end 66 of the bolt 62. The end 74 of the spacer member 72 is inserted into the aperture 76 in the bracket 58 and the other end of the spacer member 72 is slipped through the slot 82 and into the aperture 80 in the bracket 56. The spacer member nut and washer assembly 86 is loosened, as required to permit the brackets 56 and 58 to be pulled toward each other, by tightening the nut 70 to provide the desired clamping action on the sleeve sealing portions 36 and 38.

After the hoops 48 have been tightened in place, they should be tapped with a small masonry hammer or like at several locations around the circumference to insure a tight seal between the sleeve sealing portions 36 and 38 and the interior walsl of the manhole frame 12 and the manhole casing 14. This insures that the radial compressive force applied on the sealing sleeve portions by the hoops is substantially uniform around the circumference.

Use of a hoop formed from a rod-like member (instead of a relatively wide, channel-shaped or flat band) and the above-described clamping arrangement to provide a radially outwardly compression force on the sleeve sealing portions has several advantages. For instance, a stainless steel, solid rod is substantially less expensive than a wide band. The area of the compressive force provided by a rod-like member is more concentrated, resulting in a tighter seal. The tightening bolt and the spacer member can be conveniently removed to facilitate installation of the hoops and the end portions of the hoops can be conveniently spread apart to provide the desired sealing action by using a rachet wrench. The spacer member prevents the portion of the hoops behind the brackets from being pulled away from the sleeve sealing portions, thereby insuring a uniform seal around the circumference of the hoop.

Figure 4:
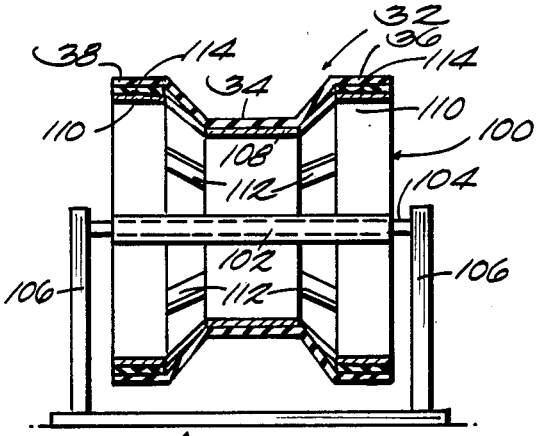
FIG. 4 is a schematic illustration of a mandrel on which a sleeve can be formed.

While the sleeve 32 can be formed by conventional extrusion and molding techniques, it preferably is formed on a mandrel from calendered sheets of uncovered rubber in order to facilitate the formation of the hoop-receiving grooves 92 and the bracket-receiving recesses 94. Schematically illustrated in FIG. 4 is a mandrel 100 suitable for forming the sleeve 32. The mandrel 100 includes a hub 102 rotatably mounted on an axle member 104 supported on a frame 106 or the like. The mandrel 100 also includes a cylindrical central rim portion 108 suitably supported from the hub 102 and having an outside diameter generally corresponding to desired inside diameter of the sleeve central portion 34. The mandrel 100 further includes a pair of cylindrical outer rim portions 110 suitably supported from the hub 102 and having an outside diameter generally corresponding to the desired inside diameter of the sleeve sealing portions 36 and 38. The central rim portion 108 and the outer end portions 110 can be connected together by a plurality of circumferentially spaced spokes 112 or solid wall sections.

Located on the outer periphery of each outer rim portion 110 is a generally semi-circular bead 114 having a shape and size corresponding to that desired for the hoop-receiving groove 92, including the segments for receiving the end portions 50 and 52 of a hoop 40. A raised boss (not shown) generally corresponding in size and shape to the bracket-receiving recess 94 is also provided on the outer periphery of each outer end portion 110.

To form a sleeve 32, a calendered sheet of uncured rubber of sufficient thickness to provide the desired thickness of the sleeve central portion 34 (e.g., 0.1875 inch) and having a width generally corresponding to the desired length of the sleeve is wrapped around the mandrel and the ends are spliced together in a conventional manner. One or more calendared sheets of the same uncured rubber having a width corresponding to the axial length of the sleeve sealing portions 36 and 38 and the added thickness to provide the desired total thickness for the sealing portions (e.g., 0.50 inch) is first wrapped around each of the outer rim portions 110 and the ends are spliced together in a conventional manner. Thus, the outer edges of the full width sheet are actually laid over these previously laid down narrower sheets to provide the thicker-walled sleeve sealing portions.

The mandrel is then moved into a curing oven wherein the rubber sheets are cured in a conventional manner, during which time the sheets fuse together to form an integral, one-piece sleeve. The thus-formed sleeve 32 is removed from the mandrel 100 in a conventional manner and, after minimal trimming, is ready for use.

By using such a technique, sleeves having an unexpanded length or vertical height of 12 inches or more can be conveniently manufactured. When an extrusion process is used, it is difficult to manufacture sleeves having an unexpanded height of much more than about 8–10 inches. Sleeves with the additional height are more adaptable for different manhole installations because a wider range of areas on the interior walls of the manhole frame and the manhole casing can be used for sealing.

Figure 5:
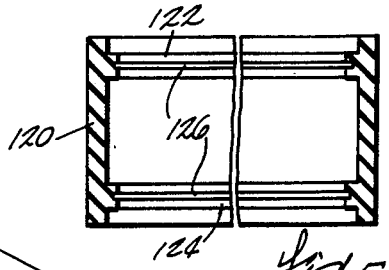
FIG. 5 is a reduced, fragmentary, sectional view of an alternate embodiment of the tubular sleeve.

FIG. 5 illustrates an alternate embodiment of the tubular sleeve. In this embodiment, the tubular sleeve 120 is generally cylindrical and has a substantially uniform wall thickness except for hoop-receiving sections 122 and 124 in the opposite ends of the sleeve 120. The hoop-receiving sections 122 and 124 include a groove 126 for receiving a hoop 48 and provide reinforced areas for accommodating the clamping or squeezing action of the hoops. The sleeve 120 is made from a material which is sufficiently flexible for the intermediate portion to "flex" inwardly to form a fold similar to that illustrated in FIG. 1.

Like the sleeve 32 illustrated in FIGS. 1–4, the sleeve 120 can be formed by conventional extrusion and molding techniques or on a mandrel as described above. When the latter technique is employed, a generally cylindrical mandrel is used. Strips of uncured rubber for forming the hoop-receiving portions are first wrapped around the mandrel and a calendared sheet of uncured rubber of substantially uniform thickness is then wrapped around the mandrel over these strips.

From the foregoing description, one skilled in the art can easily ascertain the essential characteristics of the invention and, without departing from the spirit and scope thereof, make various changes and modifications to adapt it to various usages.

I claim:

1. A sealing assembly for internally sealing the joint between hollow members having a generally circular inside diameter, said sealing assembly including a flexible tubular sleeve having an axial length sufficient to span the joint and opposite end portions respectively including first and second sealing portions, said sealing portions having an outer surface adapted to sealingly engage the interior wall of the members at locations axially spaced from the opposite sides of the joint; and a pair of adjustable expansion units, each adapted to fit inside a respective one of said first and second sealing portions and including a generally circular hoop made from a rod-like member and having end portions which vertically overlap with one end portion being located above the other and which are circumferentially movable relative to each other, a first radially inwardly extending bracket affixed on one end portion of said hoop, a second radially inwardly extending bracket circumferentially spaced from said first bracket and affixed on the other end portion of said hoop, and tightening means for adjustably moving said first and second brackets toward each other and thereby increasing the circumference of said hoop to radially compress said outer surface of the respective sleeve sealing portion into sealing engagement with the interior wall of a member.

2. A sealing assembly according to claim 1 wherein said sleeve includes a central portion of reduced diameter interposed said opposite end portions.

3. A sealing assembly according to claim 1 including spacer means for maintaining the relative orientation of said first and second brackets substantially uniform while being moved towards each other.

4. A sealing assembly according to claim 3 wherein at least said first bracket includes a first aperture; and said tightening means includes a first threaded member having one end connected to said second bracket and having an opposite outer end slidably projecting through the first aperture in said first bracket, and a nut threaded onto the outer end of said first threaded member outside of said first bracket for moving said first bracket toward said second bracket upon being tightened.

5. A sealing assembly according to claim 3 wherein said one end of said first threaded member is removably mounted on said second bracket.

6. A sealing assembly according to claim 3 wherein at least one of said first and second brackets includes a second aperture spaced radially inwardly from said tightening means; and said spacer means includes a second threaded member having one end connected to the other of said first and second brackets at a location spaced radially inwardly from said tightening means and an opposite end slidably projecting through said second aperture in said one bracket, and a nut threaded onto the outer end of said second threaded member inside of said one bracket for adjusting the distance between the outer end portions of said first and second brackets.

7. A sealing assembly according to claim 6 wherein said one bracket includes an open slot extending from said second aperture, and said one end of said second threaded member is removably mounted on said other bracket.

8. A sealing assembly according to claim 1 wherein the inner surface of each of said sleeve sealing portions includes a circumferentially extending groove for receiving a said hoop.

9. A sealing assembly according to claim 1 wherein said sleeve is made from sheets of an uncured rubber composition which are wrapped around a mandrel having an outer configuration corresponding to the inside shape and size of said sleeve and which are cured on the mandrel to form said sleeve as a one-piece unit.

10. A sealing assembly for internally sealing the corbel joint between a manhole frame and a manhole casing, said sealing assembly including a flexible tubular sleeve having an axial length sufficient to span the corbel joint and having opposite end portions respectively including first and second sealing portions, said sealing portions having an outer surface adapted to sealingly engage the interior walls of the manhole frame and the manhole casing at locations axially spaced from the opposite sides of the corbel joint; and a pair of adjustable expansion units, each adapted to fit inside a respective one of said first and second sealing portions and including a circular hoop made from a rod-like member having end portions which vertically overlap with one end portion being located above the other and which are circumferentially movable relative to each other, a first radially inwardly extending bracket affixed on one end portion of said hoop, a second radially inwardly extending bracket circumferentially spaced from said first bracket and affixed on the other end portion of said hoop, tightening means for adjustably moving said first and second brackets toward each other and thereby increasing the circumference of said hoop to radially compress said outer surface of the respective sleeve sealing portion into sealing engagement with the interior wall of the manhole frame or the manhole casing, and spacer means for maintaining the relative orientation of said first and second brackets substantially uniform while being moved toward each other.

11. A sealing assembly according to claim 10 wherein at least one said first bracket includes a first aperture;

said tightening means includes a first threaded member having one end connected to said second bracket and having an opposite said outer end slidably projecting through the first aperture in said first bracket and a nut threaded onto the outer end of said first threaded member outside of said first bracket for moving said first bracket toward said second bracket upon being tightened;

at least one of said first and second brackets includes a second aperture spaced radially inwardly from said tightening means; and said spacer means includes a second threaded member having one end connected to the other of said first and second brackets at a location spaced radially inwardly from said tightening means and an opposite end slidably projecting through said second aperture in said one bracket and a nut threaded onto the outer end of said second threaded member inside of said one bracket for adjusting the distance between the outer end portions of said first and second brackets.

12. A sealing assembly according to claim 11 wherein the inner surface of each of said sleeve sealing portions includes a circumferentially extending groove for receiving a said hoop.

13. A sealing assembly according to claim 11 wherein said sleeve is made from sheets of an uncured rubber composition which are wrapped around a mandrel having an outer configuration corresponding to the inside shape and size of said sleeve and which are cured on the mandrel to form said sleeve as a one-piece unit.

14. A sealing assembly according to claim 11 wherein said one end of said first threaded member is removably mounted on said second bracket.

15. A sealing assembly according to claim 14 wherein said one bracket includes an open slot extending from said aperture and said one end of said second threaded member is removably mounted on said other bracket.

* * * * *